US009027447B2

(12) United States Patent
Cripps

(10) Patent No.: US 9,027,447 B2
(45) Date of Patent: May 12, 2015

(54) LOCKING PLIERS WITH HANDLE LOCKING MECHANISM

(75) Inventor: Brian Cripps, Bristol, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 287 days.

(21) Appl. No.: 13/360,506

(22) Filed: Jan. 27, 2012

(65) Prior Publication Data

US 2013/0192429 A1 Aug. 1, 2013

(51) Int. Cl.
*B25B 7/14* (2006.01)
*B25B 7/12* (2006.01)

(52) U.S. Cl.
CPC ..... *B25B 7/123* (2013.01)

(58) Field of Classification Search
USPC ..... 81/318–328, 367–371, 374–379
See application file for complete search history.

(56) References Cited

U.S. PATENT DOCUMENTS

| | | | | | |
|---|---|---|---|---|---|
| 2,532,659 | A * | 12/1950 | Bruce | | 81/371 |
| 2,539,865 | A | 1/1951 | Sarvie | | |
| 2,643,567 | A * | 6/1953 | John | | 81/352 |
| 2,853,910 | A | 9/1958 | Petersen | | |
| 4,889,021 | A | 12/1989 | Morrison | | |
| 4,889,022 | A * | 12/1989 | Peviani | | 81/368 |
| 5,014,578 | A * | 5/1991 | Flentge | | 81/367 |
| 5,052,251 | A * | 10/1991 | Mills | | 81/324 |
| 5,197,359 | A * | 3/1993 | Mills | | 81/324 |
| 5,233,893 | A * | 8/1993 | Schmidt | | 81/368 |
| 6,199,458 | B1 | 3/2001 | Wrigley et al. | | |
| 6,227,080 | B1 * | 5/2001 | Grayo et al. | | 81/368 |
| 6,626,070 | B2 | 9/2003 | Peperkorn et al. | | |
| 6,941,844 | B2 | 9/2005 | Hile | | |
| 7,146,887 | B2 | 12/2006 | Hunter | | |
| 7,216,570 | B2 | 5/2007 | Seber et al. | | |
| 7,762,162 | B2 | 7/2010 | Phillips, Sr. et al. | | |
| 8,776,646 | B2 * | 7/2014 | Chervenak et al. | | 81/367 |
| 2003/0019045 | A1 | 1/2003 | Ping | | |
| 2006/0248990 | A1 | 11/2006 | Bertholf et al. | | |
| 2007/0209484 | A1 | 9/2007 | Chervenak et al. | | |
| 2008/0060486 | A1 | 3/2008 | Robert | | |
| 2010/0186558 | A1 | 7/2010 | Hile | | |
| 2012/0096995 | A1 * | 4/2012 | Shih | | 81/370 |

FOREIGN PATENT DOCUMENTS

| | | |
|---|---|---|
| WO | 92/03260 A1 | 3/1992 |
| WO | WO 97/02926 | 1/1997 |

OTHER PUBLICATIONS

Extended Search Report, including the Search Opinion, as issued for European Patent Application No. 13152679.0, dated May 2, 2013.

* cited by examiner

*Primary Examiner* — David B Thomas
(74) *Attorney, Agent, or Firm* — Pillsbury Winthrop Shaw Pittman LLP

(57) ABSTRACT

Pliers include upper structure including an upper jaw and handle extending therefrom, and lower structure including a lower jaw and handle. The lower jaw may pivot relative to the upper jaw, and the lower handle may pivot relative to the lower jaw. An overcenter linkage operatively connects between the upper and lower structure, biasing the lower handle and jaw away from the upper handle and jaw, respectively, when in a jaw-opening position, and enabling the lower jaw and handle to be retained in a closed configuration when the linkage is in a jaw-closing position. A lock member is movable between a locking configuration preventing pivoting of the lower handle from the closed configuration and retaining the jaws in a closed position, and a release configuration enabling the lower handle to be moved away from the closed configuration, allowing the jaws to move to an open position.

34 Claims, 4 Drawing Sheets

LOCKING PLIERS WITH HANDLE LOCKING MECHANISM

FIELD OF THE INVENTION

The present invention relates generally to pliers having an overcenter locking position.

BACKGROUND OF THE INVENTION

Locking pliers generally rely on an "overcenter" linkage to lock the pliers into a position compressing jaws thereof against a work piece. It may be appreciated, however, that bumping or otherwise unintentionally disturbing such pliers in such an overcenter locked position may cause the pliers to spring open and disengage from the work piece. Among other things, the present application relates to preventing pliers from unintentionally moving from an overcenter locked position.

SUMMARY OF THE INVENTION

According to one aspect of this disclosure, a pair of pliers includes an upper structure including an upper jaw and an upper handle extending from the upper jaw, and a lower structure including a lower jaw and a lower handle, the lower jaw configured to pivot relative to the upper jaw. The lower handle is configured to pivot relative to the lower jaw. The pair of pliers additionally includes an overcenter linkage operatively connected between the upper structure and the lower structure, the linkage biasing the lower handle and the lower jaw away from the upper handle and the upper jaw, respectively, when in a jaw-opening position, and enabling the lower jaw and the lower handle to be retained in a closed configuration when the linkage is in a jaw-closing position. The pair of pliers further includes a lock member movable between a locking configuration and a release configuration. When the lock member is in the locking configuration, it prevents pivoting movement of the lower handle from the closed configuration and retains the jaws in a closed position. When the lock member is in the release configuration, it enables the lower handle to be moved away from the closed configuration and allows the jaws to move to an open position.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

Features of the pliers in accordance with one embodiment are shown in the drawings, in which like reference numerals designate like elements. The drawings form part of this original disclosure in which.

DETAILED DESCRIPTION OF THE ILLUSTRATED EMBODIMENT(S)

Figure 1:
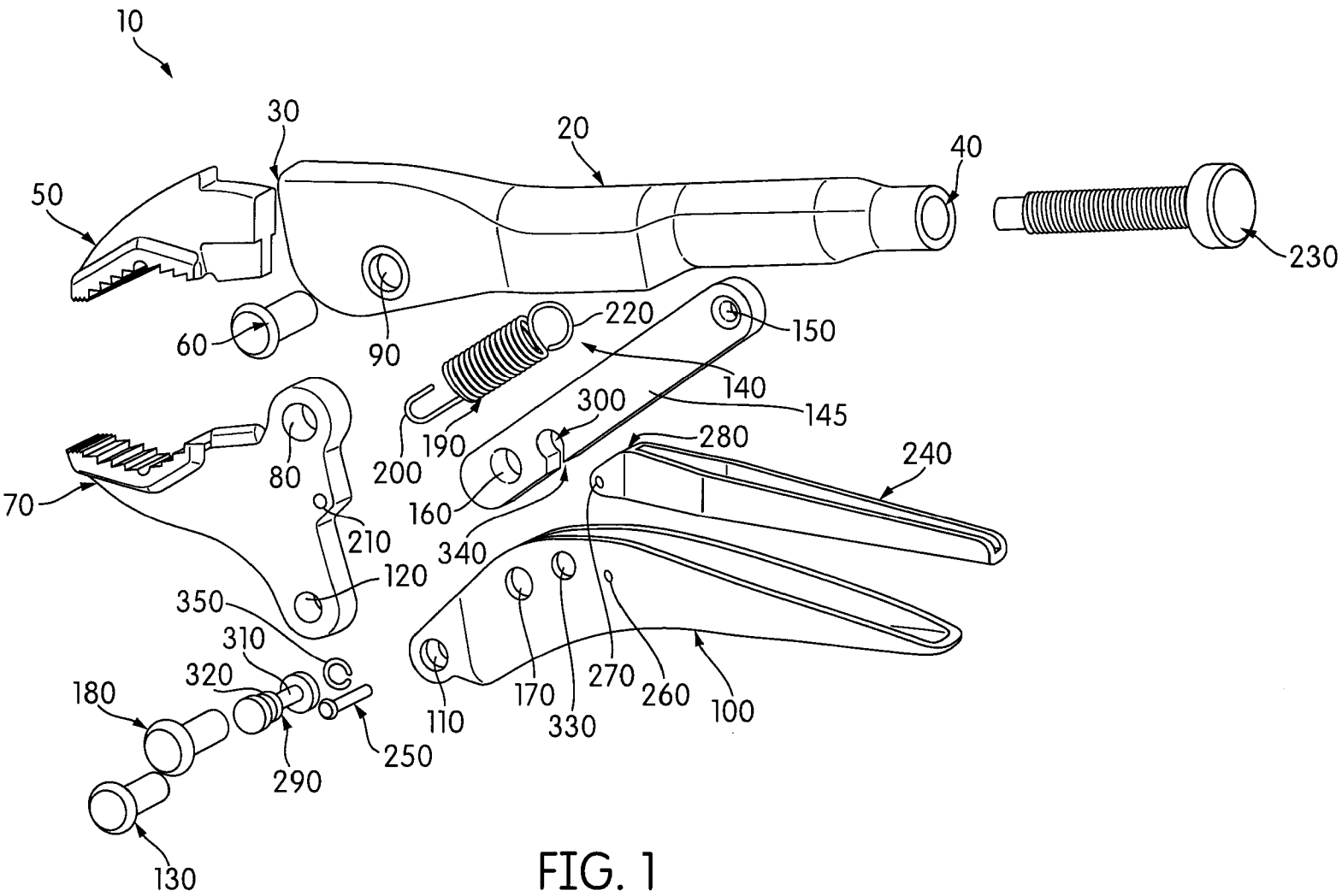
FIG. 1 is an exploded view of an embodiment of the locking pliers of the present invention, showing the constituent components thereof.

FIG. 1 illustrates an exploded view of an embodiment of a pair of locking pliers 10 of the present invention, wherein components thereof may be seen. The locking pliers 10 comprise an upper handle 20 that is elongated between a first end 30 and a second end 40. Received in the first end 30 is an upper jaw 50 of the locking pliers 10, forming an upper structure. As shown in the illustrated embodiment, the upper jaw 50 may be slidably received into the first end 30, and may be secured thereto by any appropriate manner, including but not limited to being welded, glued, removably or non-removably attached by one or more mechanical fasteners, or so on. In some embodiments, the upper jaw 50 may be integrally formed at the first end 30 of the upper handle 20.

Pivotally coupled to the handle 20 by a first pivot pin 60 is a lower jaw 70. As shown in the illustrated embodiment, a first pivot hole 80 of the lower jaw 70 is configured to be received in the upper handle 20, and align with corresponding upper handle pivot holes 90. The upper handle pivot holes 90 extend through the upper handle 20 (or otherwise formed on opposing faces of the upper handle 20) and have a receiving space therebetween to receive a portion of the lower jaw 70, such that the first pivot pin 60 passes through both the upper handle pivot holes 90 and the first pivot hole 80, holding the lower jaw 70 within the space between the upper handle pivot holes 90 by the first pivot pin 60. The lower jaw 70 is therefore able to pivot on the first pivot pin 60 relative to the upper handle 20 and the upper jaw 50. In various embodiments, the first pivot pin 60 may be configured as a screw, a bolt, a rivet, or any other appropriate body configured to pivotally secure the lower jaw 70 to the upper handle 20. It may be appreciated, then, that the lower jaw 70 may pivot with respect to the upper jaw 50, to open and close the jaws of the locking pliers 10.

Also pivotally coupled to the lower jaw 70 is a lower handle 100, which is elongated, to extend generally parallel to but below the upper handle 20. The lower jaw 70 and the lower handle 100 together form a lower structure. As shown, the lower handle 100 includes therein first lower handle pivot holes 110, that extend through the lower handle 100, and are configured to receive a portion of the lower jaw 70 therebetween. Specifically, the lower handle 100 is configured to receive a portion of the lower jaw 70 that contains a second pivot hole 120 formed therein. A second pivot pin 130 is received by both the first lower handle pivot holes 110 and the second pivot hole 120 of the lower jaw 70, to pivotally couple the lower handle 100 and the lower jaw 70. In various embodiments, the second pivot pin 130 may be configured as a screw, a bolt, a rivet, or any other appropriate body configured to pivotally secure the lower jaw 70 to the lower handle 100.

An overcenter linkage 140 operatively connects between the upper structure and the lower structure. Specifically, the linkage includes a linkage bar 145, which is configured to move into and out of an overcenter jaw-closing position, described in greater detail below. As shown, the linkage bar 145 contains therein an upper linkage pivot 150, which is configured to be pivotally coupled to a receiving region in the upper handle 20. While in some embodiments the upper linkage pivot 150 may engage an axle defining a pivot axis in the receiving region, in other embodiments the upper linkage pivot 150 may comprise a curved shape on the linkage bar 145, where the curved shape generally surrounds a pivot axis. A lower linkage pivot hole 160 of the linkage bar 145 is configured to be received by the lower handle 100. In the illustrated embodiment, the lower handle 100 includes second lower handle pivot holes 170, surrounding a region in which the lower linkage pivot hole 160 is inserted into, so that the second lower handle pivot holes 170 are aligned with the lower linkage pivot hole 160. As such, in some embodiments the lower handle 100 may have a generally U-shaped cross section. A third pivot pin 180 may therefore be inserted through both the second lower handle pivot holes 170 and the lower linkage pivot hole 160, such that the linkage bar 145 couples the lower handle 100 to the upper handle 20, and may push or pull on the assembly of the lower handle 100 and the lower jaw 70 to move the locking pliers 10 into and out of a relaxed jaw-opening position, a top-dead-center position, and the overcenter jaw-closing position, as described in greater detail below.

Further coupling the lower jaw 70 and the upper handle 20 as part of the linkage 140 may be a spring 190 having a first end 200 that is received in a receiving aperture 210 of the lower jaw 70, and a second end 220 that is received in the upper handle. As discussed in greater detail below, the spring 190 is configured to pull the lower jaw 70 open, which would generally bias the linkage bar 145 into the relaxed jaw-opening position. When the linkage bar 145 moves into the jaw-closing position, however, the lower linkage pivot hole 160 is positioned to the interior of the second pivot hole 120 and the upper linkage pivot 150 (i.e. proximal to the upper handle 20, resulting in any force applied between the upper jaw 50 and the lower jaw 70 act to drive the lower linkage pivot hole 160 further inward towards the upper handle 20, instead of causing the lower jaw 70 to open from the upper jaw 50, effectively locking the jaws around a work piece therebetween. As such, it may be appreciated that if the locking pliers 10 are bumped when in the overcenter jaw-closing position, the linkage may move from overcenter to top-dead-center (where the lower linkage pivot hole 160 is in alignment across the linkage bar 145 with the second pivot hole 120 and the upper linkage pivot 150), at which point the spring 190 may cause the linkage to spring into the relaxed jaw-opening position, opening the lower jaw 70 from the upper jaw 50, and releasing the work piece.

It may be appreciated that the positioning of the linkage bar 145 may be modified by an adjustment knob 230, which may be received in the handle 20, and configured to modify the position of the upper linkage pivot 150 relative to the handle 20. In the illustrated embodiment, the adjustment knob 230 is a turn-screw knob that extends from the second end 40 of the housing 20, and may screw into and out of the housing 20 to move a pivot axis of the linkage bar 145 in the handle 20 either closer to or further from the upper jaw 50. As such, the adjustment knob 230 may modify the angle of the linkage bar 145, to allow the lower jaw 70 and the upper jaw 50 to clamp down onto different sizes of work pieces, and with different amounts of force.

The pivotal coupling of the upper handle 20, lower jaw 70, lower handle 100, and linkage bar 145, as well as the coupling of the spring 190 therebetween, may generally allow the locking pliers 10 to operate through the squeezing of the lower handle 100 towards the upper handle 20. As the lower handle 100 is squeezed with a work piece between the upper jaw 50 and lower jaw 70, the linkage bar 145 may pivot to the top-dead-center position. As the lower handle 100 is squeezed further, the linkage bar 145 may move to the overcenter jaw-closing position, causing the locking pliers 10 to remain clamped onto the work piece. To provide a mechanical advantage to move the linkage bar 145 back to the top-dead-center or the relaxed jaw-opening positions, and thus release the work piece, a release lever 240 is pivotally coupled to the lower handle 100. As shown in FIG. 1, a release lever pivot pin 250 may be inserted through third lower handle pivot holes 260 formed in the lower handle 100, and through a corresponding release lever pivot hole 270 formed in the release lever 240. By lifting the release lever 240 towards the linkage bar 145, a fulcrum point 280 formed in the release lever 240 may press against the linkage bar 145 with sufficient force to bring the linkage bar 145 back out of the overcenter jaw-closing position, and back into the top-dead-center or relaxed jaw-opening positions, releasing the lower jaw 70.

As indicated above, it may be appreciated that the release spring 190 may be configured to promote the release of the lower jaw 70 and the linkage bar 145 from being locked in the overcenter jaw-closing position. As such, when the locking pliers 10 are locked around a work piece in the overcenter jaw-closing position, bumping or otherwise disturbing the locking pliers 10 may result in the linkage bar 145 slipping out of the overcenter jaw-closing position, leading to the lower jaw 70 opening away from the upper jaw 50. In such a situation, any work piece located between the lower jaw 70 and the upper jaw 50 may be inadvertently released. Additionally, the force of the spring 190 may cause the locking pliers 10 to spring away from the work piece and subsequently fall from where the locking pliers 10 were positioned. Such unintentional unlocking of the locking pliers 10 may also occur where a user of the locking pliers 10 accidently pulls on the release lever 240, moving the linkage bar 145 out of the overcenter locked position. As described in greater detail below, preventing such unintentional movements of the linkage bar 145 are an object of the present disclosure.

As shown in the exploded view of FIG. 1, a linkage latch 290 may be configured to lock the angle of the linkage bar 145 in place, so that the linkage bar 145 may not move out of the overcenter jaw-closing position, back into the top-dead-center or the relaxed jaw-opening positions. In the illustrated embodiment, the linkage latch 290 is configured to engage a latch receptacle 300 in the linkage bar 145. Specifically in the illustrated embodiment, the linkage latch 290 is generally formed as a cylinder having both a smaller diameter region 310 and a larger diameter region 320. The linkage latch 290 is configured to extend through a pair of latch holes 330 formed in the lower handle 100 that are positioned to be in alignment with the latch receptacle 300 when the linkage bar 145 is in the overcenter jaw-closing position. As shown in the illustrated embodiment, the latch receptacle 300 may be formed as having a cross-sectional shape of a generally enclosed circle extending through the linkage bar 145, with a side opening 340 extending to one side of the linkage bar 145. With such a configuration, the linkage latch 290 may slidably be positioned such that either the larger diameter region 320 or the smaller diameter region 310 is within the generally enclosed circular cross-sectional shape of the latch receptacle 300. When the larger diameter region 320 is positioned in the latch receptacle 300, the linkage bar 145 surrounds the larger diameter region 320, which is unable to pass through the side opening 340, preventing the linkage bar 145 from moving out of the overcenter locked position due to the engagement between the linkage latch 290 and the latch receptacle 300. Alternatively, where the linkage latch 290 is positioned such that the smaller diameter region 310 is generally surrounded by the latch receptacle 300, the linkage bar 145 may freely move from the overcenter jaw-closing position, as the smaller diameter region 310 may pass through the side opening 340 as the linkage bar 145 moves into and out of the overcenter jaw-closing position. Further shown in FIG. 1 is a snap ring 350 that may be received on the linkage latch 290, so as to provide a tactile sensation as the linkage latch 290 is moved between a locked position (where the larger diameter region 320 is positioned in the latch receptacle 300), and an unlocked position (where the smaller diameter region 310 is positioned in the latch receptacle 300).

Figure 2:
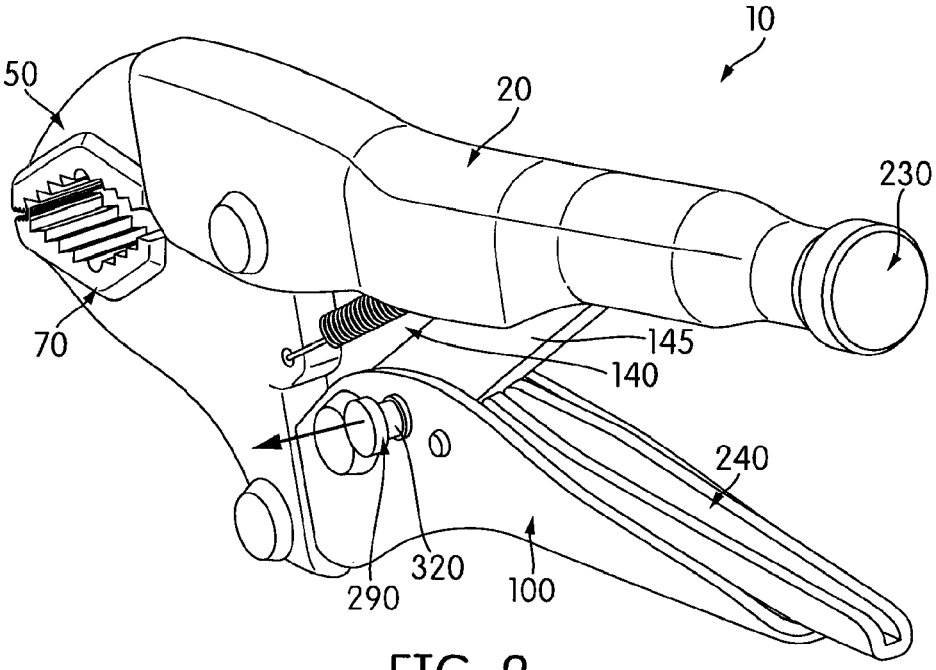
FIG. 2 is a perspective view of the embodiment of FIG. 1, showing the locking pliers in an unlocked position, whereby the locking pliers may move into and out of an overcenter locked position.
Figure 3:
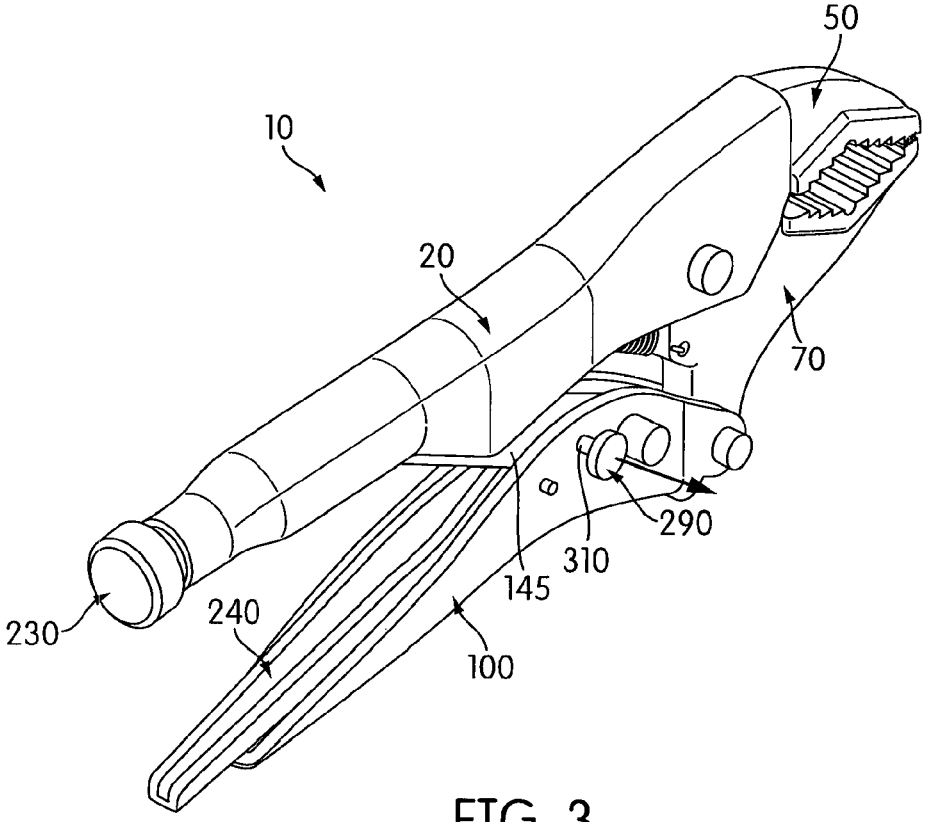
FIG. 3 is another perspective view of the embodiment of FIG. 1, showing the locking pliers in a locked position, whereby the locking pliers are prevented from moving out of the overcenter locked position.

FIGS. 2 and 3 depict perspective views of the locking pliers 10 as assembled. Specifically, FIG. 2 illustrates the locking pliers 10 where the linkage latch 290 is in the unlocked position, such that the linkage bar 145 may freely move into and out of the overcenter position. Accordingly, the smaller diameter region 310 (obscured in FIG. 2) is positioned to be in the plane of movement of the side opening 340 as the linkage bar 145 moves between the overcenter, top dead center, and relaxed jaw-opening positions. The larger diameter region 320 thus protrudes from the lower handle 100 when the locking pliers are not latched. As shown in FIG. 3, however, when the linkage latch 290 is in the locked position, the smaller diameter region 310 may extend from the lower handle 100, while the larger diameter region 320 (obscured in FIG. 3) positioned to be within the latch receptacle 300, preventing the linkage bar 145 from moving out of the overcenter locked position by being too large to pass through the side opening 340 when the linkage bar 145 attempts to move, holding the linkage bar 145 in place.

Figure 4:
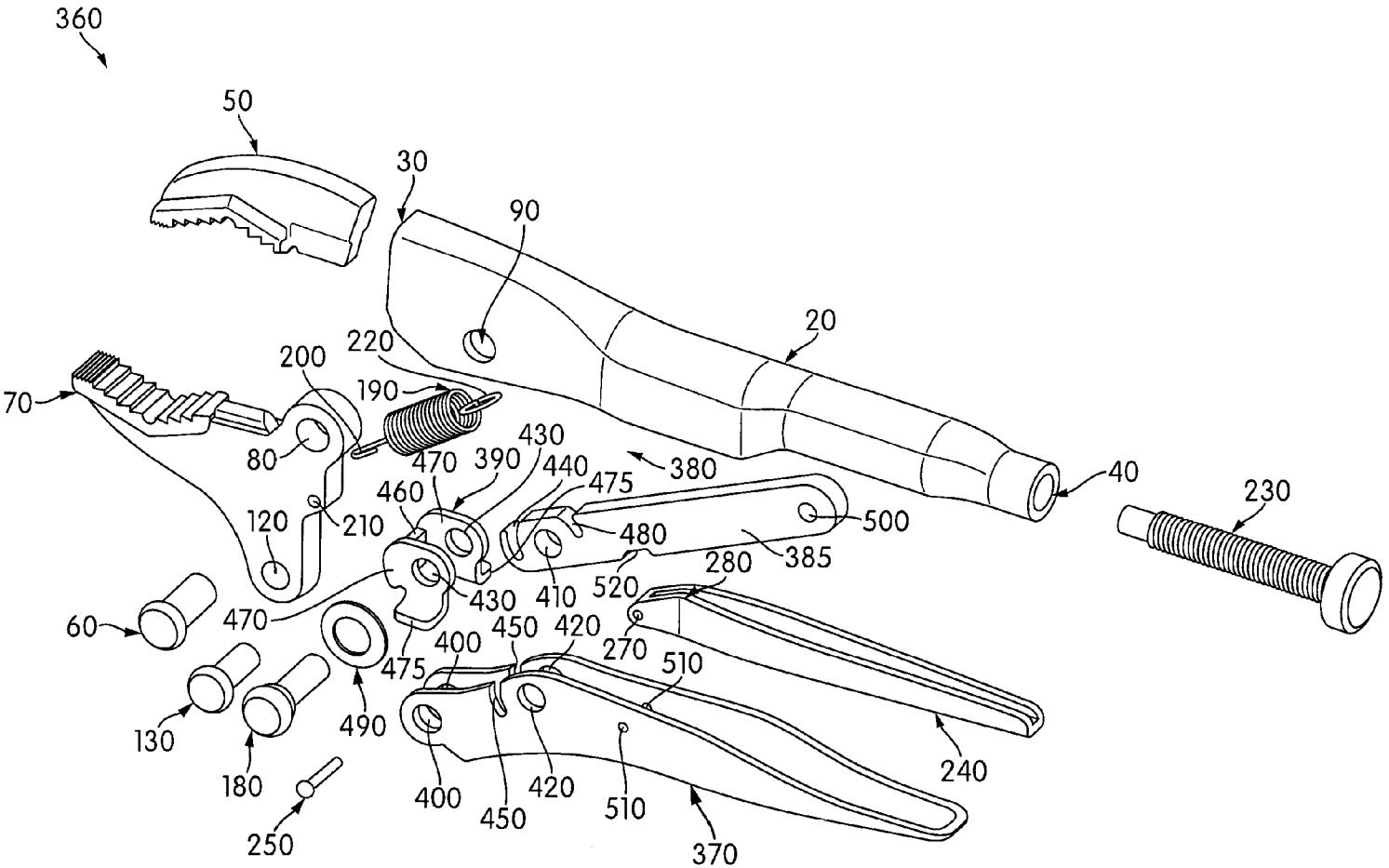
FIG. 4 is an exploded view of another embodiment of the locking pliers of the present invention, showing the constituent components thereof.

It may be appreciated that other mechanisms for preventing movement of a linkage from the overcenter locked position are also possible, and may be utilized in other embodiments. For example, FIG. 4 depicts an exploded view of a pair of locking pliers 360 that includes a lower handle 370 and a linkage 380 with a linkage bar 385, which may be locked in place relative to one another by a pivot latch 390, as described in greater detail below. Other components of the locking pliers 360 may be similar to corresponding components of the locking pliers 10, and as such, are labeled identically to those components of the locking pliers 10 depicted in FIG. 1. For example, the locking pliers 360 include the upper handle 20 having the first end 30 and the second end 40. The upper jaw 50 is received in the first end 30, while the adjustment knob 230 is received in the second end 40. The locking pliers 360 also includes the lower jaw 70, pivotally coupled to the upper handle 20 by the first pivot pin 60, that extends through the upper handle pivot holes 90 of the upper handle 20 and the first pivot hole 80 of the lower jaw 70. Additionally, the spring 190 is coupled to the upper handle 20 and the lower jaw 70, with the first end 200 being received in the receiving aperture 210 of the lower jaw 70, and the second end 220 being received in the upper handle 20.

As shown, the lower handle 370 of the locking pliers 360 is pivotally coupled to the lower jaw 70. In particular, the lower jaw 70 is received within the lower handle 370 with first lower handle pivot holes 400 of the lower handle 370 aligned with the second pivot hole 120 of the lower jaw 70, so that the second pivot pin 130 may be inserted therethrough to pivotally couple the lower jaw 70 to the lower handle 370. The linkage bar 385 contains an associated lower linkage pivot hole 410, which is received between second lower handle pivot holds 420 of the lower handle 370. Additionally, pivot latch holes 430 of the pivot latch 390 may also be aligned with the lower linkage pivot hole 410 and the second lower handle pivot holes 420, so that the third pivot pin 180 may be inserted therethrough, pivotally coupling the lower handle 370, the linkage bar 385, and the pivot latch 390 together. With such an alignment, the pivot latch 390 may rotate about the pivot pin 180, and as such may be selectively positioned to engage both a linkage latch receptacle 440 in the pivot latch 390 and lower handle latch receptacles 450 in the lower handle 370, which would lock the linkage bar 385 to the lower handle 370, preventing movement of the linkage bar 385 from the overcenter locked position. Specifically, a pivot latch bar 460 extending between pivot latch flanges 470 containing the pivot latch holes 430 may rotate into the aligned linkage latch receptacle 440 and lower handle latch receptacles 450 when the linkage bar 385 is in the overcenter locked position, thus preventing pivotal motion between the linkage bar 385 and the lower handle 370 to move the linkage bar 385 out of the overcenter locked position. In an embodiment, such movement of the pivot latch 390 may be effectuated by manipulation of handles 475 extending from the pivot latch flanges 470 for engagement by a finger of a user of the locking pliers 360. To allow the locking pliers 360 to be subsequently unlocked, the pivot latch 390 may be rotated so that the pivot latch bar 460 disengage from the lower handle latch receptacles 450 and the linkage latch receptacle 440, disconnecting the connection between the linkage bar 385 and the lower handle 370. In the illustrated embodiment, the pivot latch bar 460 is configured to be received in a second linkage latch receptacle 480 when the pivot latch 390 is rotated so as to not interfere with the pivotal motion of the linkage bar 385.

Because the locking pliers 360 has an increased number of pivoting or otherwise rotating members about the third pivot pin 180, in the illustrated embodiment a washer 490 is additionally provided to distribute the load on the third pivot pin 180, reduce wear, or otherwise act as a spacer. It may be appreciated, however, that washers such as the washer 490 are optional, and may be found associated with the other pivot pins, or may be omitted, across various embodiments. In various embodiments, other elements of the linkage bar 385 and the lower handle 370 may generally resemble and function in a manner similar to corresponding elements of the locking pliers 10. For example, the linkage bar 385 includes an upper linkage pivot 500 which similarly to upper linkage pivot 150 would be received in the upper handle 20 at a position that is modifiable by the adjustment knob 230. Additionally, the lower handle 370 includes third lower handle pivot holes 510 that may be aligned with the release lever pivot hole 270 of the release lever 240 so that the release lever pivot pin 250 may be inserted therethrough to pivotally couple the release lever 240 to the lower handle 370. As shown in the embodiment of FIG. 4, however, in some embodiments the linkage bar 385 may include a release lever receiving region 520 configured to enhance the mechanical advantage provided by the fulcrum point 280 of the release lever 240 as it engages the linkage bar 385 to move the linkage bar 385 out over the overcenter locked position.

Figure 5:
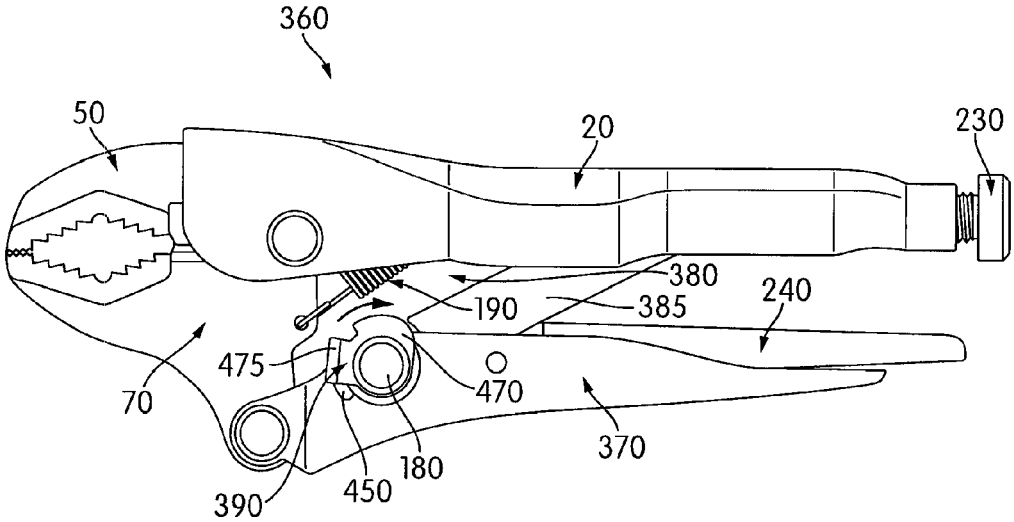
FIG. 5 is a side view of the embodiment of FIG. 4, showing the locking pliers in an unlocked position, whereby the locking pliers may move into and out of an overcenter locked position.
Figure 6:
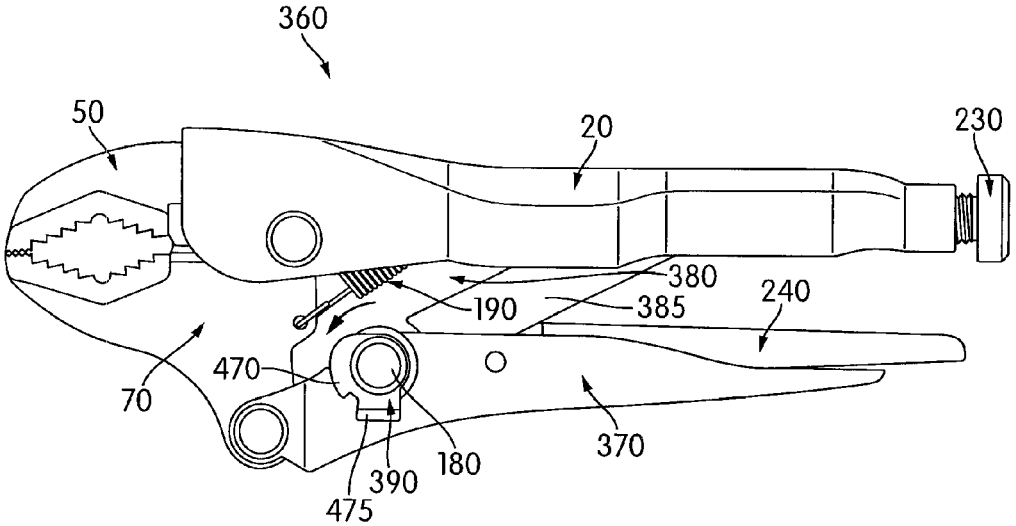
FIG. 6 is another side view of the embodiment of FIG. 4, showing the locking pliers in a locked position, whereby the locking pliers are prevented from moving out of the overcenter locked position.

FIGS. 5 and 6 depict side views of the locking pliers 360 as assembled. Specifically, FIG. 5 illustrates the locking pliers 360 where the pivot latch 390 is in the unlocked position, such that the linkage bar 385 may freely move into and out of the overcenter position. Accordingly, pivot latch bar 460 (obscured in FIG. 5) is positioned to be out of the plane of the alignment between the lower handle latch receptacles 450 and the corresponding linkage latch receptacle 440 (also obscured in FIG. 5) in the linkage bar 385, so that the linkage bar 385 may move between the overcenter, top dead center, and relaxed jaw-opening positions. Alternatively, FIG. 6 depicts the pivot latch 390 in the locked position, such that the pivot latch bar 460 is positioned in the plane of alignment between the lower handle latch receptacles 450 and the corresponding linkage latch receptacle 440, preventing the linkage bar 385 from moving relative to the lower handle 370, and thus holding the linkage bar 385 in the overcenter locked position.

Various components of the locking pliers 10, the locking pliers 360, variations thereof, or other such embodiments may each be of any suitable construction or configuration, including but not limited to being formed from metal, plastic, elastomer, wood or combinations thereof. In some embodiments, the handles (i.e. the upper handle 20 and/or the lower handles 100 or 370) may be at least partially wrapped in a grip material, including but not limited to rubber. Additionally, while in the illustrated embodiment the linkage latch 290 and the pivot latch 390 are configured to couple the linkage bars 145 or 385 to the lower handles 100 or 370, in other embodiments the linkage latch 290, the pivot latch 390, variations thereof, or other such embodiments may be configured to couple the linkages to the upper handle 20, the lower jaw 70, the upper jaw 50, or any other appropriate location of the locking pliers, so as to selectively prevent movement of the linkage from the overcenter lock position.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A pair of pliers comprising:

an upper structure including an upper jaw and an upper handle extending from the upper jaw;

a lower structure including a lower jaw and a lower handle, the lower jaw being configured to pivot relative to the upper jaw, and the lower handle being configured to pivot relative to the lower jaw;

an overcenter linkage operatively connected between the upper structure and the lower structure, the linkage biasing the lower handle and the lower jaw away from the upper handle and the upper jaw, respectively, when in a jaw-opening position, and enabling the lower jaw and the lower handle to be retained in a closed configuration when the linkage is in a jaw-closing position; and a lock member movable between a locking configuration and a release configuration, wherein when the lock member is in the locking configuration it prevents pivoting movement of the lower handle from the closed configuration and retains the jaws in a closed position, and wherein when the lock member is in the release configuration, it enables the lower handle to be moved away from the closed configuration and allows the jaws to move to an open position;

wherein the lock member is movable into and out of engagement with the linkage in a direction perpendicular to a direction of movement of the linkage.

2. The pliers of claim 1, wherein the upper handle is separately formed from and attached to the upper jaw.

3. The pliers of claim 1, wherein the upper handle is integrally formed with the upper jaw.

4. The pliers of claim 1, wherein the lower jaw and the linkage are configured to pivot about respective pivot axes in the upper handle.

5. The pliers of claim 1, wherein when the lock member is in the locking configuration, it fixedly attaches the linkage to the lower handle.

6. The pliers of claim 1, wherein the lock member is received in one or more holes extending through the lower handle.

7. The pliers of claim 1, wherein the linkage contains a lock receiving recess having a larger sized recess portion and a smaller sized recess portion, the smaller sized recess portion extending through one side of the linkage.

8. The pliers of claim 7, wherein when the lock member comprises a larger sized lock portion and a smaller sized lock portion, the larger sized lock portion being sized to be received in the larger sized recess portion but not the smaller sized recess portion, and the smaller sized lock portion being sized to be received in both the larger sized recess portion and the smaller sized recess portion.

9. The pliers of claim 8, wherein when in the locking configuration, the lock member is positioned such that the larger sized lock portion is received in the larger sized recess region, wherein when in the release configuration, the lock member is positioned such that the smaller sized lock portion is received in the larger sized recess region, but may pass through the smaller sized recess region to permit movement of the linkage.

10. The pliers of claim 8, wherein the lock member comprises a generally cylindrical shape that is slidable relative to the linkage and the lower handle across a direction of motion for the linkage, such that either the larger sized lock portion or the smaller sized lock portion may selectively be positioned within the linkage.

11. The pliers of claim 1, further comprising an adjustment knob configured to move a pivot axis associated with the linkage relative to the upper jaw.

12. The pliers of claim 1, further comprising a release lever configured to move the linkage from the jaw-closing position.

13. The pliers of claim 12, wherein the release lever is coupled to the lower handle.

14. The pliers of claim 1, wherein the linkage comprises a spring coupled to the lower jaw and the upper structure, configured to bias the lower jaw into a position spaced from the upper jaw in the jaw-opening position.

15. The pliers of claim 1, wherein the lower handle comprises a U-shaped cross section configured to receive the linkage therein.

16. The pliers of claim 1, wherein when the lock member comprises a larger diameter lock portion and a smaller diameter lock portion.

17. The pliers of claim 16, wherein when in the locking configuration, the lock member is positioned such that the larger diameter lock portion is received in a lock receiving recess of the linkage.

18. The pliers of claim 17, wherein when the larger diameter lock portion is positioned in the lock receiving recess of the linkage, the linkage surrounds the larger diameter lock portion, preventing the linkage from moving out of the jaw-closing position due to the engagement between the lock member and the lock receiving recess of the linkage.

19. The plier of claim 17, wherein when the lock member is positioned such that the smaller diameter region is generally surrounded by the lock receiving recess of the linkage, the linkage freely moves from the jaw-closing position.

20. A pair of pliers comprising:

an upper structure including an upper jaw and an upper handle extending from the upper jaw;

a lower structure including a lower jaw and a lower handle, the lower jaw being configured to pivot relative to the upper jaw, and the lower handle being configured to pivot relative to the lower jaw;

an overcenter linkage operatively connected between the upper structure and the lower structure, the linkage biasing the lower handle and the lower jaw away from the upper handle and the upper jaw, respectively, when in a jaw-opening position, and enabling the lower jaw and the lower handle to be retained in a closed configuration when the linkage is in a jaw-closing position;

a lock member movable between a locking configuration and a release configuration, wherein when the lock member is in the locking configuration it prevents pivoting movement of the lower handle from the closed configuration and retains the jaws in a closed position, and wherein when the lock member is in the release configuration, it enables the lower handle to be moved away from the closed configuration and allows the jaws to move to an open position; and a snap ring coupled to the lock member, the snap ring configured to provide a tactile indication of movement between the locking configuration and the release configuration.

21. A pair of pliers comprising:

an upper structure including an upper jaw and an upper handle extending from the upper jaw;

a lower structure including a lower jaw and a lower handle, the lower jaw being configured to pivot relative to the upper jaw, and the lower handle being configured to pivot relative to the lower jaw;

an overcenter linkage operatively connected between the upper structure and the lower structure, the linkage biasing the lower handle and the lower jaw away from the upper handle and the upper jaw, respectively, when in a jaw-opening position, and enabling the lower jaw and the lower handle to be retained in a closed configuration when the linkage is in a jaw-closing position;

a lock member movable between a locking configuration and a release configuration, wherein when the lock member is in the locking configuration it prevents pivoting movement of the lower handle from the closed configuration and retains the jaws in a closed position, and wherein when the lock member is in the release configuration, it enables the lower handle to be moved away from the closed configuration and allows the jaws to move to an open position;

wherein the linkage and the lower handle contain associated lock member recesses, wherein when the lock member is in the locking configuration, a portion of the lock member extends through the lock member recesses of the linkage and the lower handle.

22. The pliers of claim 21, wherein the lock member is rotatable between the locking configuration and the release configuration.

23. The pliers of claim 22, further comprising a latch handle coupled to the lock member and configured to facilitate rotation of the lock member between the locking configuration and the release configuration.

24. The pliers of claim 22, wherein the portion of lock member extendable through the lock member recesses of the linkage and the lower handle comprises a bar coupled to the handle, rotatable into and out of the lock member recesses through manipulation of the latch handle.

25. The pliers of claim 21, wherein the lock member is coupled to the linkage at a pivot axis of the linkage.

26. The pliers of claim 21, wherein the lock member is movable between the locking configuration and the release configuration.

27. The pliers of claim 21, further comprising a latch handle coupled to the lock member and configured to facilitate movement of the lock member between the locking configuration and the release configuration.

28. The pliers of claim 27, wherein the portion of lock member extendable through the lock member recesses of the linkage and the lower handle is configured to be movable into and out of the lock member recesses through manipulation of the latch handle.

29. The pliers of claim 27, wherein the portion of the lock member is configured to be selectively positioned to engage the lock member recesses of the linkage and the lower handle to lock the linkage to the lower handle.

30. The pliers of claim 21, wherein the lock member is configured to be moveable to engage the lock member recesses of the linkage and the lower handle to lock the linkage to the lower handle.

31. The pliers of claim 21, wherein the portion of the lock member is configured to be positioned into the lock member recesses of the linkage and the lower handle when the recesses are aligned and the lock member is in the locking configuration, thus preventing movement between the linkage and the lower handle.

32. The pliers of claim 21, wherein the movement of the lock member between the locking configuration and the release configuration is effectuated by manipulation of a handle of the lock member for engagement by a finger of a user of the locking pliers.

33. The pliers of claim 21, wherein the lock member is configured to be moveable so that the portion of the lock member disengages from lock member recesses of the linkage and the lower handle, disconnecting a connection between the linkage and the lower handle.

34. The pliers of claim 21, wherein the portion of the lock member is configured to be received in a second latch receptacle when the lock member is moved from the locking configuration and the release configuration so as to not interfere with the movement of the linkage.

* * * * *